US008840332B2

(12) United States Patent
Lhoyer

(10) Patent No.: US 8,840,332 B2
(45) Date of Patent: Sep. 23, 2014

(54) SAMPLE DISPENSER APPLICATOR FOR MASCARA

(75) Inventor: Patrick Lhoyer, Mouy (FR)

(73) Assignee: Alcan Packaging Beauty Services, Gennevilliers (FR)

( * ) Notice: Subject to any disclaimer, the term of this patent is extended or adjusted under 35 U.S.C. 154(b) by 677 days.

(21) Appl. No.: 13/058,696

(22) PCT Filed: Jul. 29, 2009

(86) PCT No.: PCT/FR2009/000947
§ 371 (c)(1), (2), (4) Date: Aug. 17, 2011

(87) PCT Pub. No.: WO2010/018320
PCT Pub. Date: Feb. 18, 2010

(65) Prior Publication Data
US 2011/0293353 A1 Dec. 1, 2011

(30) Foreign Application Priority Data
Aug. 11, 2008 (FR) ..... 08 04553

(51) Int. Cl.
*B43K 5/14* (2006.01)
*A45D 40/26* (2006.01)
*A46B 15/00* (2006.01)
*A46B 11/00* (2006.01)
*A45D 40/00* (2006.01)

(52) U.S. Cl.
CPC ..... *A45D 40/262* (2013.01); *A46B 2200/01* (2013.01); *A46B 15/0095* (2013.01); *A46B 2200/1053* (2013.01); *A46B 11/0055* (2013.01); *A46B 11/0003* (2013.01); *A45D 40/0087* (2013.01)
USPC ..... 401/132; 401/117

(58) Field of Classification Search
USPC ..... 401/132–135, 99, 116, 117
See application file for complete search history.

(56) References Cited

U.S. PATENT DOCUMENTS

| | | | | |
|---|---|---|---|---|
| 3,056,996 | A | 10/1962 | Aversa | |
| 4,982,838 | A | 1/1991 | Fitjer | |
| 6,652,176 | B2 * | 11/2003 | Dumler | 401/125 |
| 6,718,990 | B1 * | 4/2004 | Chastain et al. | 132/218 |
| 7,374,358 | B2 * | 5/2008 | Neuner et al. | 401/126 |
| 2004/0184865 | A1 | 9/2004 | Carroll | |
| 2006/0225759 | A1 | 10/2006 | Fukuda | |

FOREIGN PATENT DOCUMENTS

| | | | |
|---|---|---|---|
| FR | 2811523 | A1 | 1/2002 |
| WO | 03015567 | A | 2/2003 |
| WO | 03079846 | A | 10/2003 |
| WO | 2005032301 | A | 4/2005 |

OTHER PUBLICATIONS

International Search Report and Written Opinion mailed Nov. 9, 2009 (PCT/FR2009/000947); ISA/EP.
INPI Search Report dated May 14, 2009 (FR0804553); SA/FR.

* cited by examiner

*Primary Examiner* — David Walczak
(74) *Attorney, Agent, or Firm* — Banner & Witcoff, Ltd.

(57) ABSTRACT

Mascara sample dispenser applicators have a mascara applicator including a rod and a tip for applying the mascara to the eyelashes of the user. A receptacle contains a small amount of mascara and includes both a first opening through which the rod passes and a second opening through which the applicator tip is pushed out by translation of the rod relative to the receptacle, allowing the user to apply mascara. The second opening may be hermetically sealed by a film that cannot be returned to its original position or condition after use.

19 Claims, 4 Drawing Sheets

SAMPLE DISPENSER APPLICATOR FOR MASCARA

CROSS-REFERENCE TO RELATED APPLICATIONS

This application is a U.S. National Stage application under 35 U.S.C. §371 of International Application No. PCT/FR2009/000947 (published as WO 2010/018320 A1), filed Jul. 29, 2009, which claims priority to France patent application No. 08 04553, filed Aug. 11, 2008. Benefit of the filing date of each of these prior applications is hereby claimed. Each of these prior applications is hereby incorporated by reference in its entirety.

TECHNICAL FIELD

The invention relates to a sample dispenser applicator for mascara and more particularly a sample dispenser applicator comprising a mascara applicator with a rod and an applicator tip of the mascara on the eyelashes of the user and, a receptacle taking up a small quantity of mascara prior to use and said applicator tip and comprising at least one first opening pierced by said rod. The invention also relates to a production process of such a sample dispenser applicator and a process for using such a sample dispenser applicator.

PRIOR ART

The terms "sample" and "sample dispenser applicator" will be used hereinbelow alternately to define a dispenser also comprising an applicator and intended to receive a very low dose or a sample of cosmetic product so as to allow a user to test this cosmetic product. Such samples are for one-off or restricted use, generally fewer than four uses. They are not intended for public sale but serve as advertising or promotion media for existing products, or can carry out sampling or tests during market studies prior to launch of new products.

Also, due to the growing number of mascaras proposed for sale, users need to test some mascaras before buying to determine for example if the colour, the brilliance, the volume and the consistency of the mascara corresponds to their character or goes well with their makeup, or if the applicator tip is adapted to their eyelashes or to their wishes. As hygiene rules have progressively prohibited using mascara dispenser applicators proposed for sale for use successive by different users, there is a considerable need for a sample dispenser applicator or test model for one-off use.

Known sample dispenser applicators consist of a simple miniature of the model for sale, that is, with a reservoir onto which a stopper acting as gripping means for the applicator dipped into the reservoir is screwed, and by simply decreasing the size of the reservoir holding the mascara. The advantage of such samples is efficaciously reproducing the action and the output of the model for sale, but the retail price of such samples, at the least for the packaging part, is very high since it is very close to the retail price of the model for sale, which considerably limits the possibility for widespread distribution of samples preferred on a commercial and promotional scale. Also, the reservoirs of such miniatures are filled with mascara before introduction of the applicator tip and must contain a sufficient quantity of mascara so that the applicator tip is fully immersed in the mascara such that the quantity of mascara introduced to the reservoir approximates the 3 to 4 ml, whereas a single application of mascara to the eyelashes requires a quantity of mascara less than or equal to 1 ml. This surplus of necessary cosmetic product also represents a considerable extra cost for the producer of the sample.

Also, as such miniatures have the same characteristics as the models for sale and can consequently be reclosed after usage, users can reuse this sample a certain number of times until the mascara is used up, which can be as many as ten uses. Resulting from this multiple use of samples by users, and consequently potential consumers, is a drop in sales and a important shortfall to be gained for manufacturers and distributors as some users use the samples once only and do not buy the models for sale.

Patent documents U.S. 2006/0,225,759, U.S. Pat. No. 4,982,838 and FR 2,811,523 disclose sample dispenser applicators which are specially adapted and simplified and/or improved which, if they substantially reduce the cost of packaging of samples or improve their handling, do not reduce the quantity of cosmetic product to be introduced to the reservoir or limit the reusable character of the samples.

Problem

The essential aim of the invention is to propose a simple sample dispenser applicator, which can be made for low cost and is particularly adapted for testing.

Another essential aim of the invention is to minimise the quantity of mascara introduced to the reservoir without impairing the quality of the makeup. Another aim is for the sample dispenser applicator to be particularly adapted for single usage and for the user to be encouraged to throw away the sample dispenser applicator after use.

Finally, in the field of makeup there is the need to permanently renew product offers by putting new products on the market to satisfy new needs or those not satisfied to date, and original and novel products to attract all consumers, more specially still when this product is for promotional usage.

SUMMARY OF THE INVENTION

In this respect, the aim of the invention is a sample dispenser applicator for mascara comprising

- a mascara applicator comprising a rod and an applicator tip for mascara to the eyelashes of the user;
- a receptacle taking up a small quantity of mascara and said applicator tip, and comprising at least one first opening pierced by said rod and a second opening via which said applicator tip comes out by translation of the rod relative to the receptacle for application of said mascara by the user, characterised in that said second opening is hermetically sealed by means of a cap which cannot be returned to its original position or condition after use such that the second opening cannot be reclosed after initial use. For reasons of simplicity, translation can advantageously be done by the user by pushing on the rod relative to the receptacle in the direction of the outlet of the applicator tip.

According to a preferred embodiment of the invention, said receptacle is hermetically sealed to prevent evaporation of volatile constituents of the mascara formula, and consequently drying of the mascara in the receptacle.

Thus, said second opening can for example be hermetically sealed by means of a cap, especially thermosealed and intended to be peeled off or be punctured or percussed. It is particularly advantageous to use peelable or percussable caps, as they cannot be returned to their original position or condition after usage such that the user cannot reclose the receptacle and must throw the sample away after one-off use. Also, the caps, for example based on aluminium, are low-cost, form an excellent barrier to any evaporation and are easily thermosealed to form a totally hermetic seal. And, said first opening can be hermetically sealed by said rod. In this way, the inner circumference of said first opening corresponds perfectly to the outer circumference of the rod to former a totally hermetic seal.

Also, this interaction between the first opening and the rod favours translation of the applicator relative to the receptacle by acting as guide and keeping said applicator in position, for example when said applicator tip comes out. Advantageously, the second opening also has the same inner circumference as the outer circumference of the rod so as to hold the applicator in position relative to the receptacle when the applicator comes out.

Also, according to a particular embodiment of the invention, the receptacle is constituted by a hollow tube at one end of which a pierced stopper is inserted. Such an embodiment avoids some constraints during moulding of the different elements. The receptacle can be filled with mascara prior to insertion of the stopper. The opening in the pierced stopper corresponds to said first opening and the diameter of said opening in the stopper is particularly well adapted to the diameter of the rod. It is possible to form such a stopper from squeegees widely known in the prior art of mascara dispenser applicators. The number of squeegees in fact enables a hermetic seal between the skirt of the squeegee and the rod of a mascara applicator. The stopper can be inserted forcefully or clipped in the hollow tube.

According to another particular preferred embodiment of the invention, the inner wall of the receptacle closes up at the level of said second opening. This closing is preferably progressive, gradual, and creates progressive and adapted wringing of the excess mascara on the applicator tip.

Also, according to another particular preferred embodiment, the inner wall of the receptacle also forms a cylindrical chimney at the level of said second opening, for example in the extension of the progressive closing zone. Such a cylindrical chimney or bottleneck allows the mascara to penetrate for example into the fibres of the applicator tip in the case of an applicator tip of brush type formed from two tufts of twisted bristles enclosing fibres. In fact, the mascara is pressed against the fibres of the applicator tip during clearing of this bottleneck, enabling better distribution of the mascara, and preventing the mascara from being pressed out of the receptacle as the applicator tip comes out.

Such a sample dispenser applicator according to the invention is particularly simple and low-cost as its manufacture requires only an applicator, a receptacle, for example made in two pieces from moulded plastic, and a cap.

As the receptacle comprises a first opening and a second opening and as the outlet of the applicator tip does not occur via the first pierced opening and closed by the rod of the applicator tip, mascara can be introduced by injection into the receptacle via the first opening to place this mascara near the second opening when this second opening is closed. When the applicator tip is then introduced to the receptacle, only the free end of the applicator tip is dipped into the mascara. As mascara is a highly viscous product and almost all the volume of the receptacle serves to take up the applicator tip, mascara will stay in place near the second opening. It is when the applicator tip is being withdrawn via the second opening that the whole applicator tip will pass through the zone containing mascara and will be loaded with mascara. In this way, the total quantity of mascara necessary for loading the mascara brush can be calculated precisely and minimised for convenient one-off use.

By comparison, the same quantity of mascara had been introduced and if the applicator tip had been withdrawn via the first opening, as is known from the prior art, only the free end of the applicator tip would have received mascara and makeup would have been impossible. A far larger quantity of mascara would have to have been introduced and therefore costs would rise, giving the user the possibility of reusing the sample a number of times.

Also, according to the invention, one of the two openings cannot be reclosed after usage such that the sample can be conserved. Finally, said second opening does not comprise a squeegee system allowing of the applicator tip to return fully into the receptacle after being withdrawn, such that the external wall of the receptacle near the second opening is fouled with mascara during return of the applicator tip, encouraging the user to throw away the used sample rather than keep it. It is also possible to provide an anti-return system of the applicator tip when it is withdrawn, for example by means of notches and counter-notches formed respectively on the applicator and the receptacle.

According to another preferred embodiment of the dispenser applicator according to the invention, the mascara is in the receptacle inside a hermetically sealed compartment arranged between the applicator tip and the second opening. The compartment can be an integral part of the receptacle or be arranged inside the receptacle. The applicator tip is separated from the mascara. Said compartment then acts as cartridge and can for example comprise two walls formed by caps parallel to one another and perpendicular to the applicator tip. As the mascara is in an individual hermetic compartment, it is easy to resolve any evaporation problems of the volatile constituents of the mascara formula. Also, the caps can be made from a thermosealable film comprising an aluminium base and therefore have excellent barrier properties. The two caps are designed to be percussed and pierced successively by the free end of the applicator tip. When it comes out by translation, the applicator tip passes through the compartment filled with mascara and is loaded with mascara over its entire length. The compartment advantageously contains a small quantity of mascara appropriate for one-off use.

With such an embodiment with the mascara confined to a compartment, it is no longer necessary for the receptacle to be entirely hermetic. The receptacle acts to receive or hold the applicator and the compartment including the mascara, and to protect the applicator tip and guide the applicator.

More preferably, the sample dispenser applicator according to the invention comprises a non-reusable closing device, that is, a device preventing translation or involuntary thrust of the rod and involuntary extension of the applicator tip. Such a device can for example be a tamperproof tab stuck in an appropriate place to prevent displacement of the rod.

The invention also extends to a process for using a sample dispenser mascara applicator such as described earlier in which mascara is separated from the exterior via a cap, consisting of puncturing said cap by tapping the applicator tip against the cap. Such use is particularly advantageous in that the sample dispenser applicator is permanently monobloc and does not oblige the user to handle a cap and the applicator/receptacle assembly at the same time so that there is one hand free for example for holding a mirror. Also, once it is punctured, the cap cannot be returned to its original condition. The cap also acts as squeegee, individually or in cooperation with wringing means arranged upstream or downstream of the cap.

Such a concept for a sample dispenser applicator is, in addition to the multiple advantages cited earlier, particularly original and novel in its form and in its principle of use or handling of "syringe" type. It should consequently attract the attention of users of mascara and true commercial success.

The invention will be better understood by way of the following detailed description and the attached Figures given by way of non-limiting example.

DETAILED DESCRIPTION OF THE INVENTION

Figure 2A:
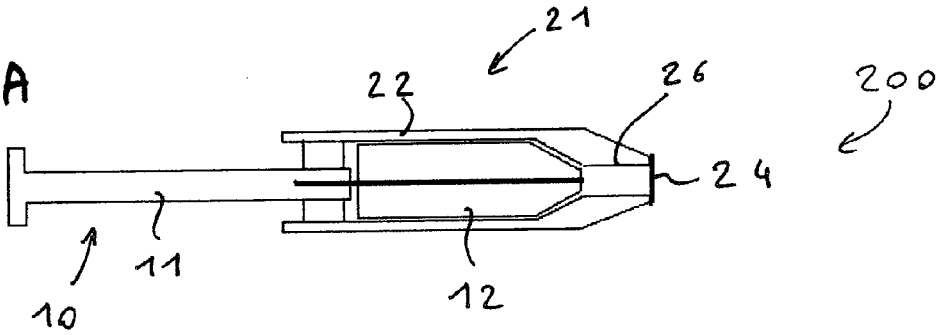
FIG. 2A illustrates in a sectional view a second embodiment of a sample dispenser applicator in a closed situation.
Figure 2B:
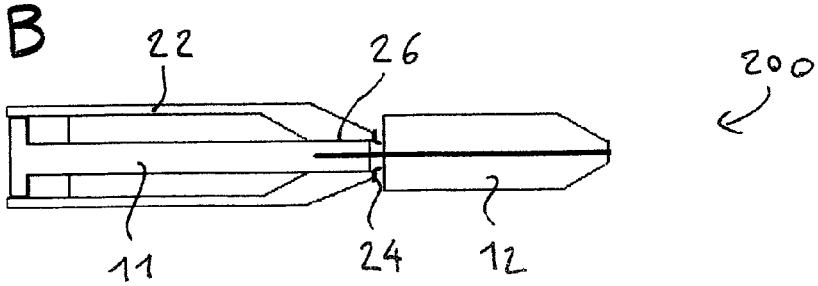
FIG. 2B illustrates in a sectional view the sample of FIG. 2A in an open situation.
Figure 2C:
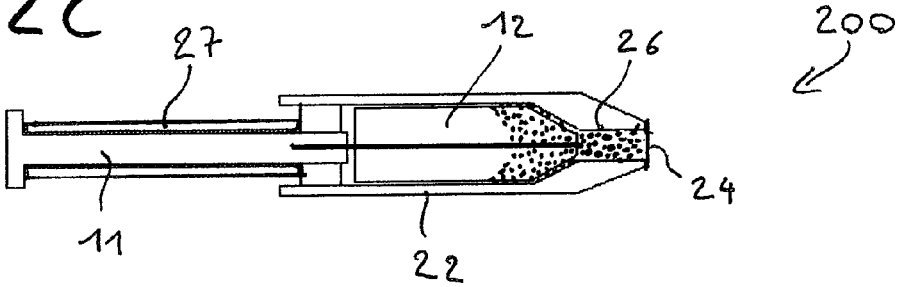
FIG. 2C illustrates in a sectional view the sample of FIG. 2A with the receptacle charge of mascara and a non-reusable closing device.
Figure 2D:
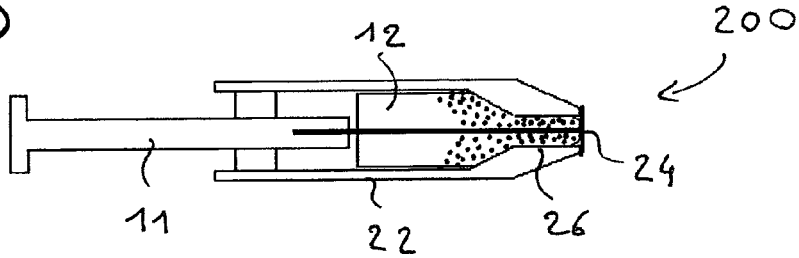
FIG. 2D illustrates in a sectional view the sample of FIG. 2C in an intermediate situation.
Figure 2E:
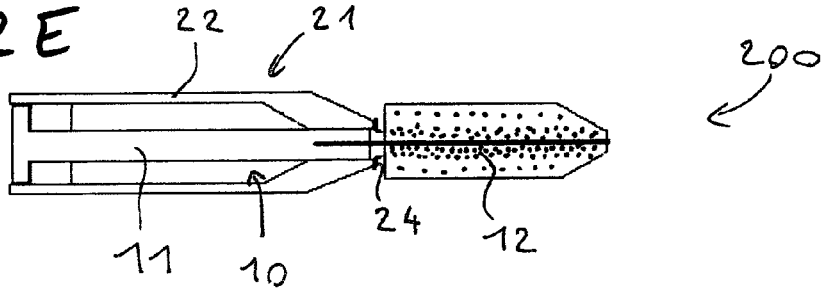
FIG. 2E illustrates in a sectional view the sample of FIG. 2C in an open situation.

For the sake of clarity, mascara has been sketched in only in FIG. 2C to 2E. Also, the samples are more particularly cylindrical such that their sectional view allows the overall structure of the samples to be appreciated, apart from the sample presented in FIG. 5A to 5D.

Figure 1A:
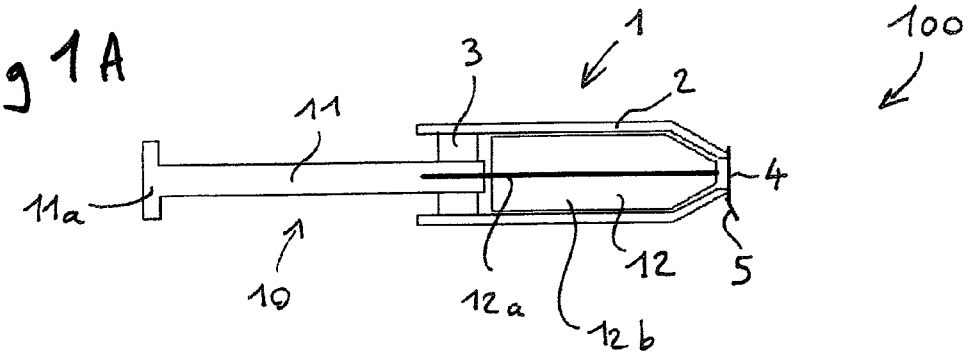
FIG. 1A illustrates in a sectional view a first embodiment of a sample dispenser applicator in a closed situation.
Figure 1B:
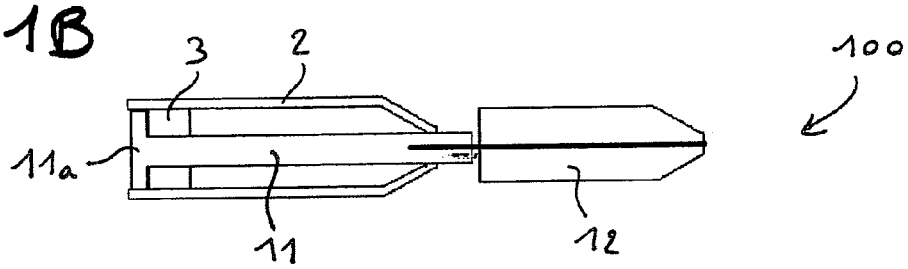
FIG. 1B illustrates in a sectional view the sample of FIG. 1A in an open situation.

FIGS. 1A and 1B illustrate a first embodiment of a sample dispenser applicator 100 of the invention comprising a receptacle 1 constituted by a hollow tube 2 and a pierced stopper 3, an applicator 10 constituted by a rod 11 and an applicator tip 12, and a cap 4.

FIG. 1A shows the sample 100 in a closed situation, that is, prior to use by a user, while FIG. 1B shows the same sample 100 in an open situation, that is, ready for application on eyelashes of the user.

The pierced stopper 3 is inserted into the hollow tube 2, at a first open end of the hollow tube 2 to form the receptacle 1. The pierced stopper 3 can be for example unstuck, clipped into the hollow tube or again inserted by force into the hollow tube. The joint between the pierced stopper 3 and the hollow tube 2 is hermetic. The hole in the pierced stopper forms a first opening in the receptacle. The second open end of the hollow tube forms a second opening in the receptacle.

In the closed situation, the pierced stopper 3 is passed through by the rod 11 of the applicator 10 and allows this rod 11 to exit from the receptacle 1. The inner diameter of the opening of the pierced stopper 3 has a diameter corresponding to the outer diameter of the rod 11 of the applicator 10 so as to hermetically seal this opening. The second opening of the receptacle is also hermetically sealed by a cap 4 thermosealed on the hollow tube 2 such that the receptacle forms a hermetically sealed reservoir inside which the mascara does not dry out.

The cap 4 comprises a grip tab 5 for peeling the cap to open the second opening prior to use of the sample. The cap is for example a thermosealable film based on aluminium having a low cost, and forms an excellent barrier to any evaporation.

The pierced stopper 3 can for example be an element whereof the design is inspired by squeegees for mascara applicators which form a hermetic seal with an applicator rod.

In the closed situation, the applicator tip 12 is arranged with the mascara in the receptacle 1. The rod 11 extends beyond the receptacle via the first opening.

The applicator tip 12 is for example a classic mascara brush of "twisted wire brush" type, that is, with a twisted metallic wire 12*a* clamping a plurality of bristles 12*b*. One end of the twisted metallic wire core of this brush is inserted and fixed in the rod.

Advantageously, according to the invention, it is possible to use the applicator tip of the dispenser applicator intended for sale corresponding to the sample.

To use the sample 100 according to the invention, the user removes the cap 4 closing the second opening and presses on the free end of the rod while holding the receptacle 1 by the hollow tube 2. The applicator 10 is translated relative to the receptacle 1 and the applicator tip 12 exits via the second opening, as seen in FIG. 1B.

The free end of the rod 11 comprises a support plate 11*a* transversal to the rod so that the user can easily press on the rod and also to act as final stop against the stopper 3 when the applicator tip 12 comes out.

The inner wall of the hollow tube 2 closes up at the level of the second opening so as to wring the excess mascara on the applicator tip when the applicator tip is taken out.

In the open situation, the rod 11 passes through the first opening and the second opening of the receptacle 1 and the applicator tip 12 exits from the receptacle. The hollow tube acts as gripping means for the applicator 10.

The diameter of the second opening also corresponds to the outer diameter of the rod 11 of the applicator 10 to ensure proper holding and stability of the applicator 10 relative to the receptacle 1 when the tip is brought out for application.

As evident in FIGS. 1A and 1B, the stopper 3 can be inserted sufficiently deeply into the end open of the hollow tube 2 to leave a space inside which the support plate 11*a* lodges when the applicator tip 12 is brought out. The user can no longer grasp the rod to pull it out and put the applicator tip 12 back into the receptacle, so she has to throw away the sample 100 after one-off use. It is also possible to provide an irreversible detenting system between the hollow tube and the rod to prevent return of the applicator tip to the receptacle.

Thus, the hollow tube 2 shrinks externally in the form of a point at the level of the second opening such that if the user does puts the applicator tip 12 back into the receptacle after use, the excess mascara still present on the brush will be deposited onto the outer wall of the hollow tube 2 and will foul the sample which then has to be thrown out.

Advantageously, in a closed situation the sample 100 comprises a non-reusable closing device preventing the applicator tip from coming out involuntarily when the rod is pushed. The user must pull out or neutralise this non-reusable closing device to be able to use the sample. Such a non-reusable closing device is shown for example in FIG. 2C.

FIGS. 2A and 2B show a second embodiment of a sample dispenser applicator 200 of the invention, respectively in a closed situation and in an open situation. The second sample 200 differs from the first sample 100 by the shape of the receptacle, especially at the level of the second opening, and by the absence of a tab on the cap, presuming a different mode of use.

The second sample 200 comprises a receptacle 21 formed from a hollow tube 22 having an inner wall forming a bottleneck or chimney 26 in the extension of the progressive clearing at the level of the second opening. The function of such a chimney 26 is to force the mascara to be distributed evenly over the entire applicator tip 12, more particularly when the quantity of mascara injected into the receptacle has been minimised.

Also, the second opening has been hermetically sealed by a thermosealable cap 24 not having a peel-off grip tab.

Such a cap 24 is intended to be punctured by percussion of the free end of the applicator tip against the cap 24.

Thus, when the user wants to use the sample 200, she holds the hollow tube 22 and presses on the rod 11 of the applicator 10, causing translation of the rod 11 relative to the receptacle 21 and consequently translation of the applicator tip 12 relative to the cap 24. The applicator tip 12 then percusses and punctures the cap 24 prior to exiting from the receptacle 21. Such a mode of use is particularly advantageous because it does not need an operation for prior removal of a cap or a cap which one would not know what do to with it during the application and which can engender fouling due to previous contact with the mascara. Further, once it is punctured, the cap 24 can act as squeegee. Such opening by percussion by the applicator tip also limits to the maximum the quantity of mascara present between the free end of the applicator tip and the second opening during opening of the sample and which risks being pushed out of the receptacle.

An aluminium-based cap is perfectly convenient for opening by percussion.

With the sample according to the invention, it is possible to minimise the quantity of mascara introduced into the receptacle. The applicator tip has actually not come out of the reservoir via the opening pierced by the rod of the applicator, contrary to what happens in samples of the prior art.

It is actually possible to inject mascara into the receptacle only close to the second opening, as shown in dotted lines in FIG. 2C to 2E.

Making the sample dispenser applicator 200 consists of providing a receptacle 21 cap, injecting a given quantity of mascara near the cap 24 via by the first opening, then introducing the applicator 10 via this same first opening. By minimising the quantity of mascara introduced, only the free end of the applicator tip 12 is dipped into the mascara, as seen in FIG. 2C. The mascara has such a viscosity that this arrangement in the receptacle will not change over time or with handling of the sample in a closed situation.

As evident in FIG. 2C, the sample 200 filled with mascara in a closed situation also comprises a non-reusable closing device 27, preventing unwanted translation of the rod 11 relative to the receptacle 21. A tab stuck on the rod can for example act as non-reusable closing device. The user will have to remove this tamperproof tab before using the sample. The non-reusable closing device could again be formed by a split hollow tube clipped onto the rod 11. In FIG. 2D, showing an intermediate step of use of the sample, just before the cap 24 is punctured by the applicator tip 12, the free end of the applicator tip is inserted in the chimney 26 and has partially chased the mascara to the interior of the receptacle, enabling the central part of the applicator tip to load with mascara. As the entire applicator tip passes through the zone in which the mascara is stored, the entire applicator tip is loaded with mascara once it emerges. Also, all the mascara introduced to the receptacle has been used and it is consequently possible to fill the receptacle with only that quantity of mascara wanted for one-off use, that is, around 0.5 to 1 ml of mascara.

Once the applicator tip is out, as shown in FIG. 2E, the concentration of mascara is stronger close to the core of the applicator tip than at its periphery, the latter having less mascara to make it easier to comb the eyelashes. The part of the hollow tube 22 at the level of the second opening and the cap punctured acts as squeegee.

Figure 3A:
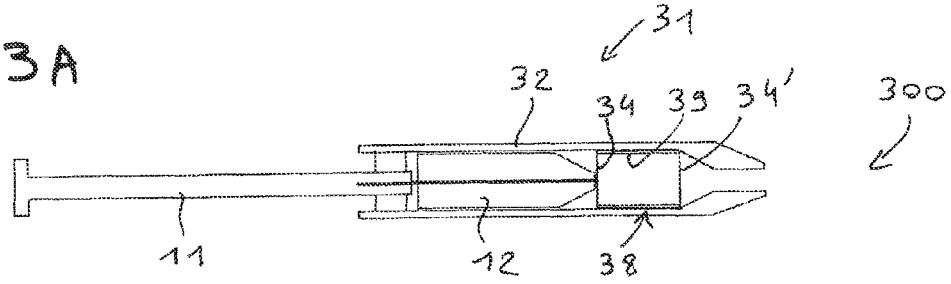
FIG. 3A illustrates in a sectional view a third embodiment of a sample dispenser applicator in a closed situation.
Figure 3B:
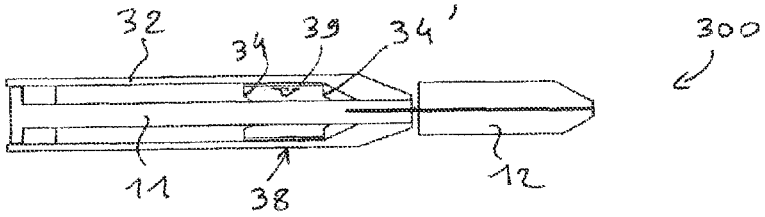
FIG. 3B illustrates in a sectional view the sample of FIG. 3A in an open situation.

FIGS. 3A and 3B show a third embodiment of a sample dispenser applicator 300 of the invention, respectively in a closed situation and in an open situation. The third sample 300 differs from the two preceding samples in that the mascara is arranged, in a closed situation, in a hermetic compartment 38 and separated from the applicator tip 12.

The third sample 300 comprises a receptacle 31 formed by a hollow tube 32 of sufficient length to accommodate an applicator tip 12 and the hermetically sealed compartment 38, this compartment 38 being arranged in the receptacle between the applicator tip 12 and the second opening. The compartment 38 acts as cartridge and contains mascara. It is no longer necessary for the whole receptacle to be hermetically sealed. The compartment 38 is more particularly formed by a hollow and cylindrical lateral wall 39 closed by two caps 34, 34'. The two caps 34, 34' are parallel to each other and perpendicular to the applicator tip 12 and to the direction of translation of the applicator tip when it exits from the receptacle 31.

During use of the sample 300, the user holds the hollow tube 32 and presses on the rod 11 of the applicator such that the applicator tip punctured the first cap 34, passes through the compartment 38 containing the mascara, punctured the second cap 34', passes through the part of the hollow tube 32 at the level of the second opening acting as squeegee and exits from the receptacle ready for application. The applicator tip 12 is loaded with mascara when the compartment 38 is pierced.

The compartment 38 contains the quantity of mascara necessary for one-off use.

Figure 4A:
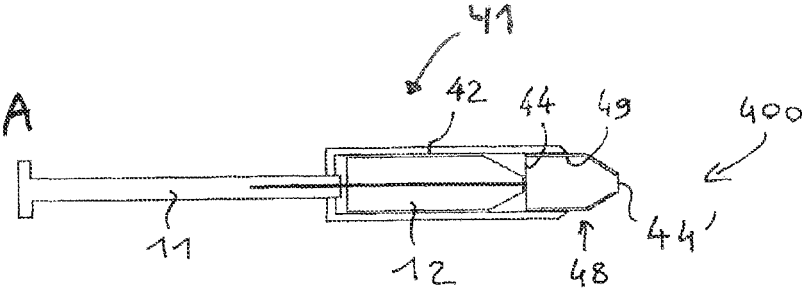
FIG. 4A illustrates in a sectional view a fourth embodiment of a sample dispenser applicator in a closed situation.
Figure 4B:
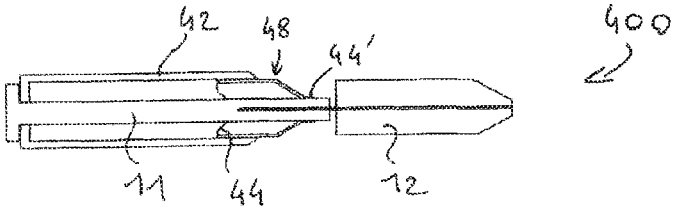
FIG. 4B illustrates in a sectional view the sample of FIG. 4A in an open situation.
Figure 5A:
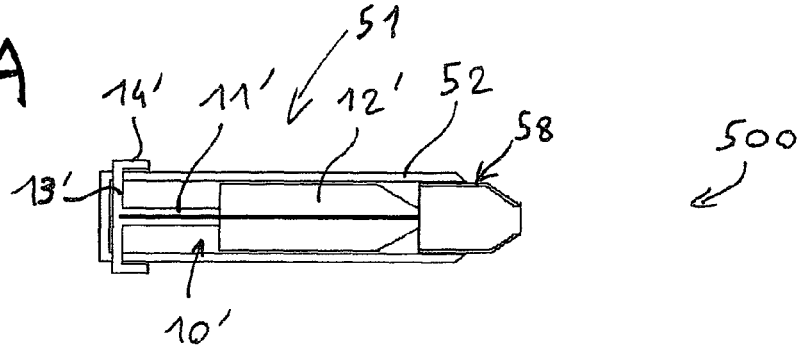
FIG. 5A illustrates in a sectional view a fifth embodiment of a sample dispenser applicator in a closed situation.
Figure 5C:
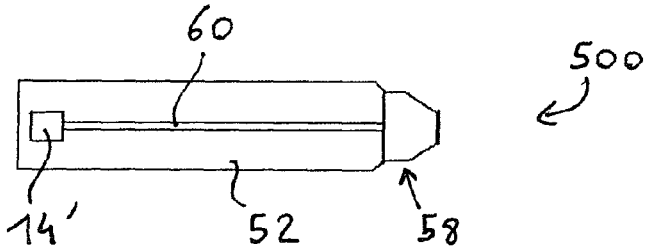
FIG. 5C illustrates in a plan view the sample of FIG. 5A.
Figure 5B:
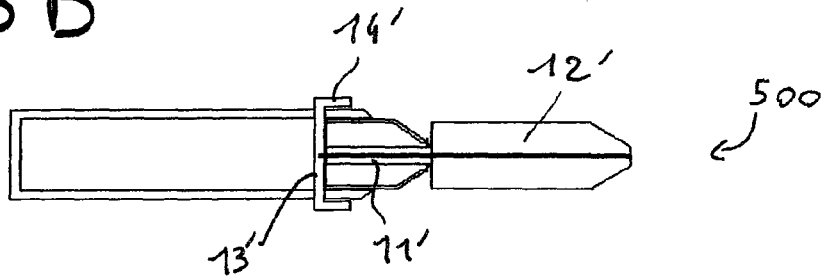
FIG. 5B illustrates in a sectional view the sample of FIG. 5A in an open situation.
Figure 5D:
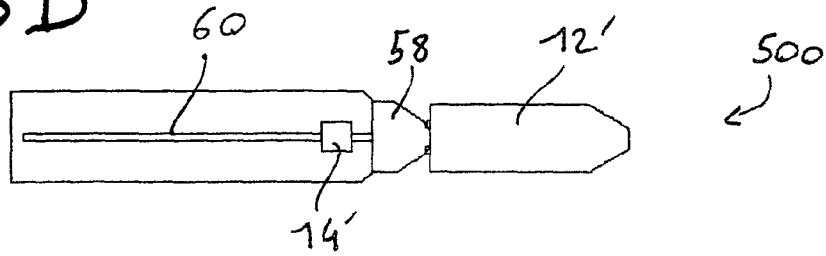
FIG. 5D illustrates in a plan view the sample of FIG. 5B.

FIGS. 4A and 4B show a fourth embodiment of a sample dispenser applicator 400 of the invention, respectively in a closed situation and in an open situation.

The fourth sample 400 comprises a receptacle 41 constituted by a hollow tube 42 at one end of which is inserted a hermetically sealed compartment 48. The mascara is arranged inside the compartment between a first cap 44 and a second cap 44'. The hollow tube 42 serves more particularly to guide the rod 11 of the applicator 10 via a first opening, to protect the applicator tip 12 against any degradation and to hold the compartment 48 in the extension of the applicator tip 12. The second cap 44' closes the second opening of the receptacle 41 and the compartment 48 comprises a hollow lateral wall 49, partially cylindrical then conical, as it closes up at the level of the second opening. In this embodiment, it is the lateral wall 49 which acts as squeegee.

FIGS. 5A, 5C and 5B, 5D show a fifth embodiment of a sample dispenser applicator 500 of the invention, respectively in a closed situation and in an open situation. The fifth sample 500 differs from the fourth sample 400 in the way it handles the rod of the applicator relative to the receptacle.

The fifth sample 500 comprises a receptacle 51 constituted by a hollow tube 52 at one end of which is inserted a hermetically sealed compartment 58 containing mascara. The hollow tube 52 is closed at the end opposite the end taking up the compartment 58 and comprises two slots 60, as visible in FIGS. 5C and 5D, in a plan view. The fifth sample also comprises an applicator 10' having a rod 11' forming two branches 13' extending perpendicularly to the applicator tip 12' and passing through the slots 60 which form a first opening of the receptacle 51. The branches 13' each terminate in plates 14' for easy handling of the rod 11'. To use such a fifth sample 500, the user holds the receptacle 51 by the hollow tube 52, grasps the plates 14' and slides the rod 11' along the slots 60 such that the applicator tip 12' passes through the compartment 58 and exits the receptacle 51.

To make such a fifth sample 500, the applicator tip 12' is introduced to the hollow tube by sliding the rod 11' in the slots 60 then inserting the compartment into the hollow tube 52. The compartment 58 can for example be unstuck or unclipped from the hollow tube 52.

The invention obviously extends to all modifications of the sample dispenser applicator according to the invention which would be evident for the person skilled in the art. Five particular embodiments of the invention each comprising certain particular characteristics are illustrated in the figures and described hereinabove. The invention is obviously not limited to these five embodiments and some characteristics of an embodiment can obviously be integrated in another embodiment or modified from the general knowledge of the person skilled in the art.

The invention claimed is:

1. A sample dispenser applicator for mascara comprising a mascara applicator comprising a rod and an applicator tip for applying mascara to the eyelashes of the user;

a receptacle holding a small quantity of mascara and said applicator tip, and comprising at least one first opening pierced by said rod and a second opening via which said applicator tip comes out by translation of the rod relative to the receptacle for application of said mascara by the user, characterised in that said second opening is hermetically sealed by means of a cap which cannot be returned to its original position or condition after usage such that the second opening cannot be reclosed after initial use, wherein said applicator tip is configured to puncture said cap by percussing against the cap.

2. The sample dispenser applicator as claimed in claim 1, in which translation is done by pushing on the rod relative to the receptacle in the direction of an outlet of the applicator tip.

3. The sample dispenser applicator of claim 1, in which said receptacle is hermetically sealed.

4. The sample dispenser applicator of claim 1, in which said first opening is hermetically sealed by said rod.

5. The sample dispenser applicator of claim 1, in which the receptacle is constituted by a hollow tube at one end of which a pierced stopper is inserted.

6. The sample dispenser applicator of claim 1, in which an inner wall of the receptacle closes up at the level of said second opening.

7. The sample dispenser applicator as claimed in claim 6 in which the inner wall also forms a cylindrical chimney at the level of said second opening.

8. The sample dispenser applicator of claim 1, in which said second opening has a diameter equivalent to the diameter of the rod of the applicator.

9. The sample dispenser applicator of claim 1, in which the mascara is in the receptacle inside a hermetically sealed compartment arranged between the applicator tip and the second opening.

10. The sample dispenser applicator of claim 9, in which the compartment comprises two walls formed by said cap and an additional cap, wherein said cap and said additional cap are parallel to one another and perpendicular to the applicator tip.

11. The sample dispenser applicator of claim 1, comprising a non-reusable closing device.

12. A production process of a sample dispenser applicator, comprising:

providing a receptacle comprising a first opening and a second opening;

providing an applicator comprising an applicator tip and a rod;

introducing mascara to the receptacle via the first opening; then introducing the applicator tip into the receptacle via the same first opening, wherein the applicator tip is configured to puncture a cap for hermetically sealing the second opening.

13. The process as claimed in claim 12, also comprising closing said second opening with the cap prior to introducing mascara to the receptacle by injecting mascara into the receptacle close to said second opening.

14. The process as claimed in claim 12, wherein introducing mascara to the receptacle comprises introducing a hermetic compartment filled with mascara and comprising two opposite walls formed by means of said cap and an additional cap.

15. A method for using a sample mascara dispenser applicator, the method comprising puncturing a cap of the mascara dispenser applicator by percussion of an applicator tip against the cap, wherein, prior to puncturing, mascara is contained in the mascara dispenser applicator by the cap, wherein the applicator tip is at one end of a rod, and wherein a receptacle comprises a first opening pierced by the rod and a second opening via which the applicator tip comes out by translation of the rod relative to the receptacle.

16. A sample dispenser applicator for mascara comprising a mascara applicator comprising a rod and an applicator tip for applying mascara to the eyelashes of the user;

a receptacle holding a small quantity of mascara and said applicator tip, and comprising at least one first opening pierced by said rod and a second opening via which said applicator tip comes out by translation of the rod relative to the receptacle for application of said mascara by the user, wherein said second opening is hermetically sealed by means of a cap which cannot be returned to its original position or condition after usage such that the second opening cannot be reclosed after initial use, wherein the mascara is in the receptacle inside a hermetically sealed compartment arranged between the applicator tip and the second opening.

17. The sample dispenser applicator of claim 16, wherein the compartment comprises two walls formed by said cap and an additional cap, wherein said cap and said additional cap are parallel to one another and perpendicular to the applicator tip.

18. The sample dispenser applicator of claim 16, wherein translation is done by pushing on the rod relative to the receptacle in the direction of an outlet of the applicator tip.

19. The sample dispenser of claim 16, wherein the first opening is hermetically sealed by the rod.

* * * * *